United States Patent [19]

Brick et al.

[11] Patent Number: 4,555,689

[45] Date of Patent: Nov. 26, 1985

[54] ELEVATOR SYSTEM WITH LAMP STATUS AND MALFUNCTION MONITORING

[75] Inventors: Michael J. Brick, Wallingford, Conn.; Linus R. Dirnberger, Randolph, N.J.

[73] Assignee: Westinghouse Electric Corp., Pittsburgh, Pa.

[21] Appl. No.: 527,919

[22] Filed: Aug. 30, 1983

[51] Int. Cl.[4] ..... B66B 3/00

[52] U.S. Cl. ..... 340/19 R; 187/29 R

[58] Field of Search ..... 187/29 R; 340/19 R, 340/825.52, 642, 505

[56] References Cited

U.S. PATENT DOCUMENTS

| | | | |
|---|---|---|---|
| 3,903,499 | 9/1975 | Oliver | 340/19 R |
| 4,234,866 | 11/1980 | Kuroda et al. | 340/642 X |
| 4,383,240 | 5/1983 | Staats, Jr. | 340/642 X |
| 4,418,795 | 12/1983 | Trosky et al. | 187/29 R |
| 4,458,788 | 7/1984 | LePore | 187/29 R |

OTHER PUBLICATIONS

"On-Board Multiplexing System Checks Car's Lights Automatically", *Electronics*, Aug. 30, 1979, pp. 68, 70, J. Gosch.

*Primary Examiner*—James L. Rowland
*Assistant Examiner*—Brian R. Tumm
*Attorney, Agent, or Firm*—D. R. Lackey

[57] ABSTRACT

An elevator system including an elevator car, a controller for directing the elevator car to serve the floors of a building, lamps at each floor served by the elevator car, and a processor at each floor, including a microcomputer, for energizing and deenergizing the associated lamps. The controller issues illumination commands which indicate the desired illumination status for predetermined lamps, which commands are implemented by the processor associated with the lamp. Each processor includes a detector which determines the actual illumination status of the lamp in question, and a comparator for comparing the actual status and the commanded status, to detect lamp malfunctions. A malfunction detection is stored and used to prevent the associated lamp from subsequently being energized, until service personnel have corrected the problem.

5 Claims, 12 Drawing Figures

DOOR OPERATOR
FLOOR HEIGHT TABLE (ROM)
CAR POSITION COUNTER (RAM)
ADVANCED CAR POSITION (RAM)
HALL LANTERN CONTROLLER (2ND FLOOR)
D.C. REGULATOR
TO SYSTEM PROCESSOR & OTHER CARS
HALL LANTERN CONTROLLER (TOP FLOOR)
HALL LANTERN CONTROLLER (1ST FLOOR)
CAR CONTROLLER
HALL CALL CONTROL
CAR CALL CONTROL
PULSE CONTROL
DRIVE MACHINE
TOP
2ND
1ST
DN
UP
+5V

ELEVATOR SYSTEM WITH LAMP STATUS AND MALFUNCTION MONITORING

BACKGROUND OF THE INVENTION

1. Field of the Invention:

The invention relates in general to elevator systems, and more specifically to an elevator system having a new and improved arrangement for detecting, and then bypassing, faults in elevator associated lamps disposed at the various floors of a building.

2. Description of the Prior Art

An elevator system includes a plurality of lamps disposed at each floor of the associated building. For example, a conventional hall lantern arrangement for each intermediate floor of a building includes two lamps and a gong for each elevator car. The terminal floors each have a single lamp and a gong for each elevator car. Each floor also includes a lamp for each hall call pushbutton, which is illuminated when a call is entered to provide visual confirmation of call entry.

Copending application Ser. No. 527,920 filed Aug. 30, 1983, entitled "Elevator System" discloses an elevator system in which the hall lanterns at each floor of a building are controlled by a hall lantern controller. Each hall lantern controller includes a microcomputer, which includes a microprocessor. The communication between the car controller of the associated elevator car, which also includes a digital computer, and the hall lantern controllers, is serial. Only three wires are required in the hoistway for full duplex (two-way) communication between the car controller and its associated hall lantern controllers. Complicated wiring patterns are avoided by utilizing a microcomputer in each hall lantern.

The car controller prepares an illumination command for a specific hall lantern controller, using a unique floor address or identification code assigned to the hall lantern controller to be communicated with. All of the hall lantern controllers constantly monitor the serial communication link and when a message is placed on the link by the associated car controller, each hall lantern controller compares its unique address with the address portion of the message. When the message address matches the unique address of a hall lantern controller, the associated hall lantern controller responds to the remaining portion of the message, implementing the requested illumination command. After a command has been implemented, such as a command to turn on the up hall lantern, a command to turn on the down hall lantern, or a command to turn off the hall lanterns, the hall lantern controller sends a message back to the car controller which acknowledges reception and performance of the command.

A floor related microcomputer can also be used to detect the entry of a hall call, send a detected call to a dispatcher function over a communication link, and receive illumination commands back from the dispatcher function over this link for controlling the lamps associated with the hall call buttons.

Controllers or processors which utilize microcomputers may be damaged if allowed to energize a fault, beyond a very short period of time, such as a shorted lamp circuit.

SUMMARY OF THE INVENTION

Briefly, the present invention protects a controller or processor which controls the illumination status of lamps in response to illumination commands, by immediately testing the result of its implementation. This test function includes detector means for determining the actual illumination status of the lamp in question, and comparator means for comparing the actual status with the commanded status. If they do not agree, the lamp is immediately deenergized, if the illumination command requested illumination, and an indication that this specific lamp is faulty is stored in a memory. In a preferred embodiment, this indication is stored in two memories, one associated with the microcomputer located in the floor related processor, and one in a memory associated with a microcomputer in the car controller. The floor related processor, upon detecting a malfunction, stores this fact in its own memory, and it communicates this fact to the car controller over the communication link. The information in the car controller memory will thus contain the faulty lamp information relative to all of the floors served by the elevator car, and this information may be retrieved locally, or sent to a remote service location, to aid service personnel.

The car controller memory, or the floor related processor memories, or both, can be used to prevent subsequent energization of a faulty lamp. In one embodiment, the car controller checks its own memory prior to the issuance of an illumination command to energize a predetermined lamp. If its memory indicates this lamp is faulty, the illumination command will not request lamp turn on. If the lamp is a hall lantern, the car controller can still prepare a command which requests that the hall lantern gong be sounded, to notify prospective passengers of imminent car arrival. In another embodiment, the car controller prepares illumination commands without reference to its own memory. Each controller or processor at each floor, upon receiving an illumination command for one of its associated lamps which requests energization, checks its own memory prior to implementation of the command. If the lamp is found to be faulty, the command is not implemented. However, if the associated lamp is a hall lantern, the processor will energize the gong.

BRIEF DESCRIPTION OF THE DRAWINGS

The invention may be better understood, and further advantages and used thereof more readily apparent, when considered in view of the following detailed description of exemplary embodiments, taken with the accompanying drawings in which.

DESCRIPTION OF THE PREFERRED EMBODIMENTS

Broadly, the present invention is a new and improved elevator system having means for detecting faulty lamps located at the various floors of the associated building. The lamps at each floor are controlled by a controller or processor at the floor which receives illumination commands over a communication link from a central processor, such as a car controller or a dispatcher control. For purposes of example, the invention will be described relative to the lamps of the hall lanterns, but it is to be understood that the invention applies equally to the detection of other per-floor lamps controlled by a processor which includes a microcomputer. Certain of the hall lantern apparatus disclosed but not claimed in the present application is disclosed and claimed in the hereinbefore mentioned copending application Ser. No. 527,920.

The invention will be described by illustrating only those parts of an elevator system which are pertinent to the understanding of the invention, with the remaining portions of a complete elevator system being incorporated by reference to issued patents assigned to the same assignee as the present application. Accordingly, U.S. Pat. Nos. 3,750,850 and 4,240,527 are incorporated into the specification of the present application by reference. U.S. Pat. No. 3,750,850 sets forth a car controller, including a floor selector and a speed pattern generator. The floor selector of this patent may be used to provide certain signals used by the hall lantern control. U.S. Pat. No. 4,240,527 discloses a bidding arrangement and a Priority Executive for placing program modules into bid and running them according to the highest priority program currently bid.

Figure 1:
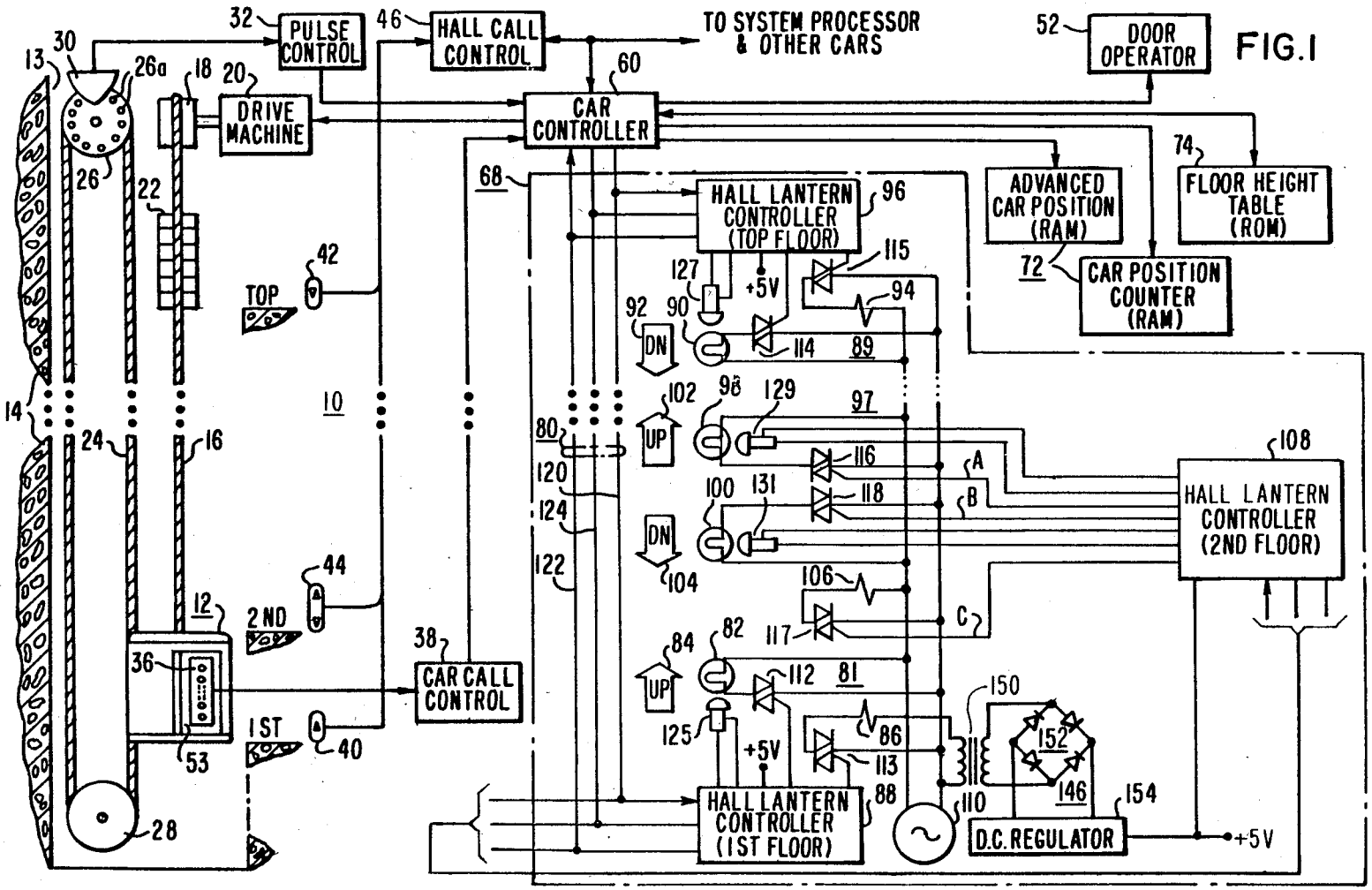
FIG. 1 is a schematic diagram of an elevator system constructed according to the teachings of the invention.
Figure 2:
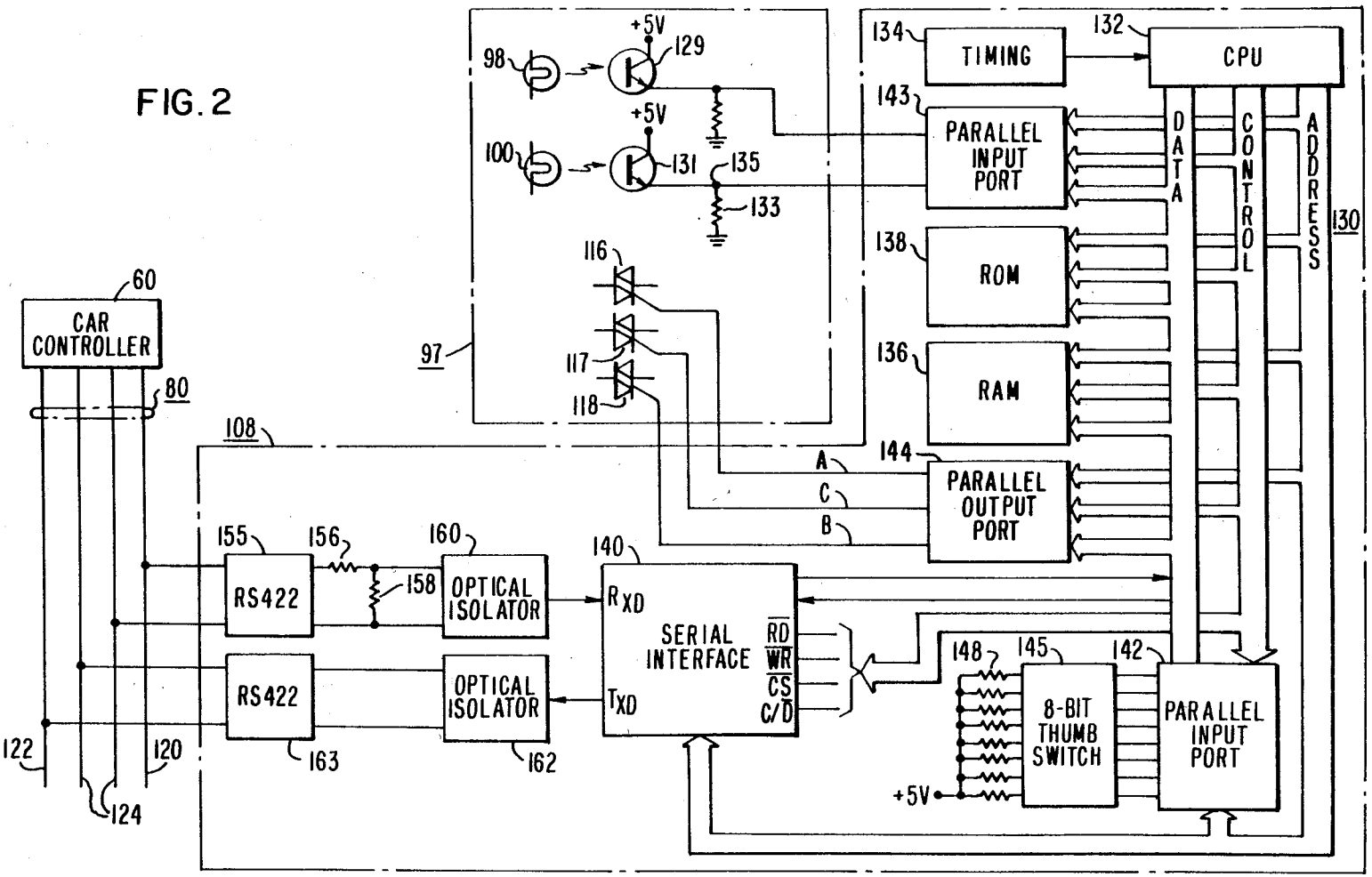
FIG. 2 is a partially schematic and partially block diagram of a hall lantern controller which may be used for the hall lantern controllers shown in block form in FIG. 1.
Figure 3:
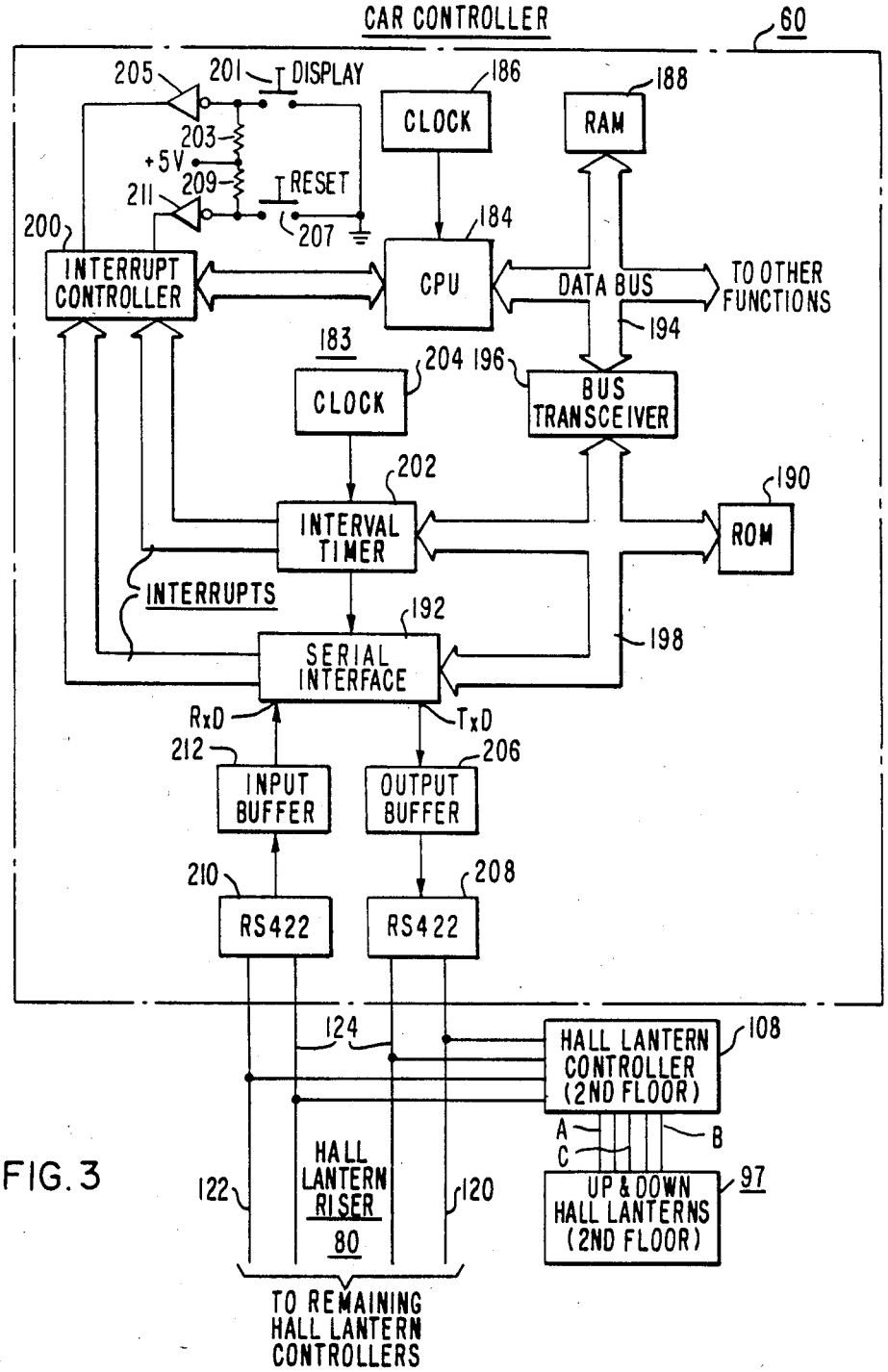
FIG. 3 is a partially schematic and partially block diagram of a car controller which may be used for the car controller shown in block form in FIG. 1.

Referring now to the drawings, FIG. 1 is a schematic diagram of an elevator system constructed according to the teachings of the invention, and FIGS. 2 and 3 expand upon portions of FIG. 1 which are shown in block form.

FIG. 1 illustrates an elevator system 10 which includes an elevator car 12, the movement of which is controlled by a car controller 60, which in turn may be controlled by a system processor (not shown), when the system is under group supervisory control. The car controller 60 includes a floor selector and a speed pattern generator. The floor selector is described in detail in incorporated U.S. Pat. No. 3,750,850. It is sufficient for the understanding of the present invention to state that the floor selector, in addition to providing signals for door control 52, provides signals $\overline{HLU}$, $\overline{HLD}$ and $\overline{DORR}$, which are used by hall lantern control 68. Signals $\overline{HLU}$ and $\overline{HLD}$ are hall lantern enable signals, which, when true, respectively indicate the up and down hall lanterns should be illuminated. Signal $\overline{HLU}$ switches low or true when the floor selector detects that the elevator car 12, when traveling upwardly, should start to decelerate to stop at a floor. Signal $\overline{HLD}$ switches low or true when the elevator car 12, when traveling downwardly, should start to decelerate and stop at a floor. Signal $\overline{DORR}$ switches low or true when the elevator car 12 is stopped at a landing and the door non-interference time expires Signal $\overline{DORR}$ is used to initiate door closing, and it may also be used as the signal to turn off a hall lantern.

Car 12 is mounted in a hatchway or hoistway 13 for movement relative to a structure 14 having a plurality of floors or landings, with only the first, second and top floors or landings being shown. Car 12 is supported by a plurality of wire ropes 16 which are reeved over a traction sheave 18 mounted on the shaft of a drive machine 20. The drive machine 20 may be an AC system having an AC drive motor, or a DC system having a DC drive motor, as desired. A suitable drive machine 20, along with its associated closed loop feedback control is shown in detail in U.S. Pat. No. 4,277,825, which is assigned to the same assignee as the present application.

A counterweight 22 is connected to the other ends of the ropes 16. A governor rope 24, which is connected to the car 12, is reeved about a governor sheave 26 located above the highest point of travel of the car 12 in the hoistway 13, and over a pulley 28 located at the bottom of the hoistway. A pick-up 30 is disposed to detect movement of the elevator car 12 through the effect of circumferentially-spaced openings 26*a* in the governor sheave 26, or in a separate pulse wheel which is rotated in response to the rotation of the governor sheave. The openings 26*a* are spaced to provide a pulse for each standard increment of travel of the elevator car 12, such as a pulse for each 0.25 inch of car travel. Pick-up 30 may be of any suitable type, such as optical or magnetic. Pick-up 30 is connected to pulse control 32 which provides distance pulses for the car controller 60.

Car calls, as registered by pushbutton array 36 mounted in the car 12, are processed by car call control 38, and the resulting information is directed to the car controller 60.

Hall calls, as registered by pushbuttons mounted in the hallways, such as the up pushbutton 40 located at the first floor, the down pushbutton 42 located at the top floor, and the up and down pushbuttons 44 located at the second and other intermediate floors, are processed in hall call control 46. The resulting processed hall call information is directed to the car controller 60.

Car controller 60 tabulates the distance pulses from the pulse detector 32 in an up/down counter, such as a counter maintained in random access memory (RAM) 72, to develop information concerning the precise position of the car 12 in the hoistway 13, to the resolution of the standard increment. When the car 12 is level with the lowest floor, the car position count, referred to as POS16, is zero. The POS16 count when the car is level with each floor is used as a first address for the associated floor. A floor height table, in terms of the standard increment, may be maintained in a read-only memory (ROM) 74.

An advanced car position, in terms of the standard increment, may be developed by adding, or subtracting, a count value equal to the required slow-down distance for the current speed of the elevator car. When the advanced car position matches a floor address in the floor height table, the car should immediately initiate slowdown, if the floor is a target floor. This is the point at which the appropriate hall lantern would be enabled, or turned on. If the floor is not a target floor, the advanced floor position for the elevator car 12, referred to as the AVP floor, or simply as AVP, should be incremented, or decremented, depending upon travel direction. The advanced floor position AVP is the closest floor ahead of the elevator car 12 in its travel direction at which the car can stop according to a predetermined deceleration schedule. The target floor, mentioned earlier, is the floor at which the car 12 should stop, to serve a car call or a hall call, or simply to park.

The hall lantern control 68 includes a serial hall lantern riser 80, hall lantern means at each floor, such as lamps and a gong, and a hall lantern controller at each floor. For example, the lowest or first floor includes hall lantern means 81 and a hall lantern controller 88. The hall lantern means 81 may include an up direction hall lamp 82, such as an incandescent bulb, or other suitable source of visible electromagnetic radiation, which may illuminate an up direction arrow 84, and a gong 86, or other suitable audible indicator. The top floor includes hall lantern means 89 and a hall lantern controller 96. The hall lantern means 89 may include a down direction lamp 90 which illuminates a down direction arrow 92 and a gong 94. The second floor, and other intermediate floors, may include hall lantern means 97 and a hall lantern controller 108. The hall lantern means 97 may include up and down direction lamps 98 and 100, respectively, which illuminate up and down direction arrows 102 and 104, respectively, and a gong 106.

Each hall lantern controller controls the energization of the hall lantern lamps at its associated floor. For example a common source 110 of electrical potential, such as an AC source, and a solid state switch for each lamp and gong, may be used, such as switches 112 and 113 for the first floor, switches 114 and 115 for the top floor, and switches 116, 117 and 118 for the second floor. Switches 116 and 118, for example, may respectively connect lamps 98 and 100 across source 110, while switch 117 may connect gong 106 across source 110. The solid state switches may be triacs. A triac triggers or turns on when gate drive current is applied to its gate electrode, and it turns off at the first voltage zero crossing following removal of gate drive. The gate electrodes of the switches are controlled by a microcomputer which is part of the associated hall lantern controller, with the hall lantern controller providing gate drive current from an output port of the microcomputer when a lamp should be energized, and removing gate drive current when the lamp should be deenergized.

The various hall lantern controllers are located at their associated floors, and they all receive illumination command signals over the serial hall lantern riser 80. Hall lantern riser 80 includes a conductor 120 for serial message transmissions from the car controller 60 to the plurality of hall lantern controllers, a conductor 122 for serial message transmissions from the hall lantern controllers to the car controller 60, and a common conductor 124. Conductors 120, 122 and 124 extend from the car controller 60, which may be located in the machine room, through hoistway 13, past all of the floors, for easy connection to each of the hall lantern controllers. The hall lantern controllers are of similar construction, and thus only the hall lantern controller 108 for the second floor is shown in detail.

More specifically, as shown in FIG. 2, each hall lantern controller is implemented by a digital computer 130, and more specifically by a single chip microcomputer such as Intel's 8748. Computer 130, for example, includes a central processing unit (CPU) 132, system timing or clock 134, a random access memory (RAM) 136, a read-only memory (ROM) 138, a serial interface 140 for communication with the riser 80, a parallel input port 142 for receiving a unique identification code, a parallel input port 143 for receiving signals indicative of actual lamp status, and a parallel output port 144 having an output for gong activation, and latchable outputs for controlling the state of the associated hall lanterns or lamps.

An important part of the invention is the detection of the actual illumination status of each lamp, i.e., to detect the on/off status of a lamp. This function is provided by a sensor disposed immediately adjacent to a lamp, which provides an input for input port 143. The sensors, such as sensors 125, 127, 129 and 131 shown in FIG. 1 for lamps 82, 90, 98 and 100, respectively, may include temperature sensitive thermistors arranged to bias a transistor in response to the heat of an energized lamp; photodetectors, such as the phototransistors 129 and 131 shown in FIG. 2; or any other suitable detector. The function of these sensors is merely to detect whether or not the associated lamp is on or off. They do not determine if a short or open circuit exists. The logic for this function will be hereinafter disclosed and described. As shown in FIG. 2 relative to phototransistor 131, a source of unidirectional potential may be connected to its collector electrode, a resistor 133 may be connected from its emitter electrode to ground, and the junction 135 between resistor 133 and the emitter may be connected to input port 143. The phototransistor 131, such as T.I.'s TIL 99, may include a lens, if desired, to make the phototransistor directional, if interfering light sources may be present. Thus, when lamp 100 is off, transistor 131 is non-conductive and the junction 135 will be at ground, i.e., at the logic zero level. When lamp 100 is on, transistor 131 will conduct and junction 135 will be at the voltage level of the unidirectional source, i.e., at the logic one voltage level. Thus, CPU 132 can determine the actual status of each of the lamps it is controlling by placing the address of port 143 on the address bus, and by placing a read signal $\overline{RD}$ on the control bus. Port 143 will then place its input information on the data bus for use by CPU 132.

A unique identification code for each hall lantern controller may be provided by an eight-bit thumb DIP switch 145, which is connected to a source of unidirectional potential via eight resistors, indicated generally at 148. A unidirectional potential may be provided by source 146 shown in FIG. 1, having a transformer 150 connected to AC source 110, a full-wave, single-phase bridge rectifier 152, and a DC regulator 154.

Conductor 120 of the serial data riser 80 may be connected to an input terminal R×D of serial interface 140 via an RS422 header 155, input resistors 156 and 158 and an optical isolator 160. Input resistors 156 and 158 allow the use of any desired voltage on the riser 80, by proper selection of their values. The output terminal T×D of serial interface 140 may be connected to conductor 122 of riser 80, via an optical isolator 162, and RS422 header 163.

In order to maintain gate drive current for a selected solid state switch which drives a lamp, without the necessity of providing a new gate drive signal each voltage half cycle of source 110, parallel output port 144 may be of the type which includes latchable outputs, or it may be used in conjunction with suitable memory devices, such as flip-flops. For purposes of example, it will be assumed that parallel output port includes latchable outputs A and B for controlling lamps 98 and 100, and an output C for controlling gong 106. Output A is connected to the gate electrode of solid state switch 116, output B is connected to the gate electrode of solid state switch 118 and output C is connected to the gate electrode of solid state switch 117. When lamp 98 is to be energized, CPU 132 provides a signal for parallel output port 144 which latches its output A at the logic one level. CPU controls lamp 100 in a similar manner, causing output port B of parallel output port 144 to be latched at the logic one level, when lamp 100 is to be energized. The gong 106 is controlled by port C, which is driven high and then low, each time the gong should sound. It it is desired to sound the gong twice for one travel direction, such as down, and once for the up travel direction, CPU 132 would drive the associated output high twice in succession to generate two spaced sounds. FIG. 3 is a partially schematic and partially block diagram which illustrates the serial communication hall lantern riser 80 and its connections to the car controller 60. Car controller 60 may include a single board microcomputer 183, such as Intel's iSBC80/24 TM, having a CPU 184, such as Intel's 8085A microprocessor. The clock 186, such as Intel's 8224, provides system timing. Microcomputer 183 further includes a random access memory (RAM) 188, a read-only memory (ROM) 190, and a serial interface 192, such as Intel's 8251A. CPU 184 communicates with RAM 188, and its many other functions, via a data bus 194. A bus transceiver 196, such as Intel's 8287, may interface bus 194 with a bus 198, with bus 198 serving ROM 190 and the serial interface 192.

The CPU 184 may be interrupt driven, directly through its on-board interrupt inputs, and any additional interrupts may be handled via an interrupt controller 200, such as Intel's 8259A. For example, as will be hereinafter explained in detail, a predetermined memory location of RAM 188 may be displayed on a CRT screen, or a hard copy of the information may be printed, or both, in response to an interrupt generated manually by a pushbutton 201, a resistor 203, a source of unidirectional potential, and an inverter gate 205. The predetermined location may be reset after display or printout by a pushbutton 207, a resistor 209, a source of unidirectional potential, and an inverter gate 211. An interval timer 202, such as Intel's 8253, and a clock 204, such as Intel's 8224, may provide timing for interface 192, and it may also provide additional interrupts for the interrupt controller 200.

Serial interface 192 provides an interrupt request to the interrupt controller 200 when it is ready to transmit information, and it also provides an interrupt request when it has received information and is ready to transfer it to a memory address to be provided by CPU 184.

Serial interface 192 includes a serial output port TxD which is connected to a buffer or driver 206 and to an RS422 header 208. Driver 206 may be Motorola's MC34878. Header 208 is connected to conductors 120 and 124 of the hall lantern riser 80. Serial interface 192 also includes a serial input port R×D. Conductors 122 and 124 of hall lantern riser 80 are connected to input R×D via an RS422 header 210 and a buffer or receiver 212. Receiver 212 may be Motorola's MC34868. Clock 204, interval timer 202, serial interface 192, driver 206, receiver 212 and headers 208 and 210 may be mounted on a separate board, such as Intel's iSBX351 TM Serial Module TM Board which may be plugged into the 80/24 Board.

Figure 4:
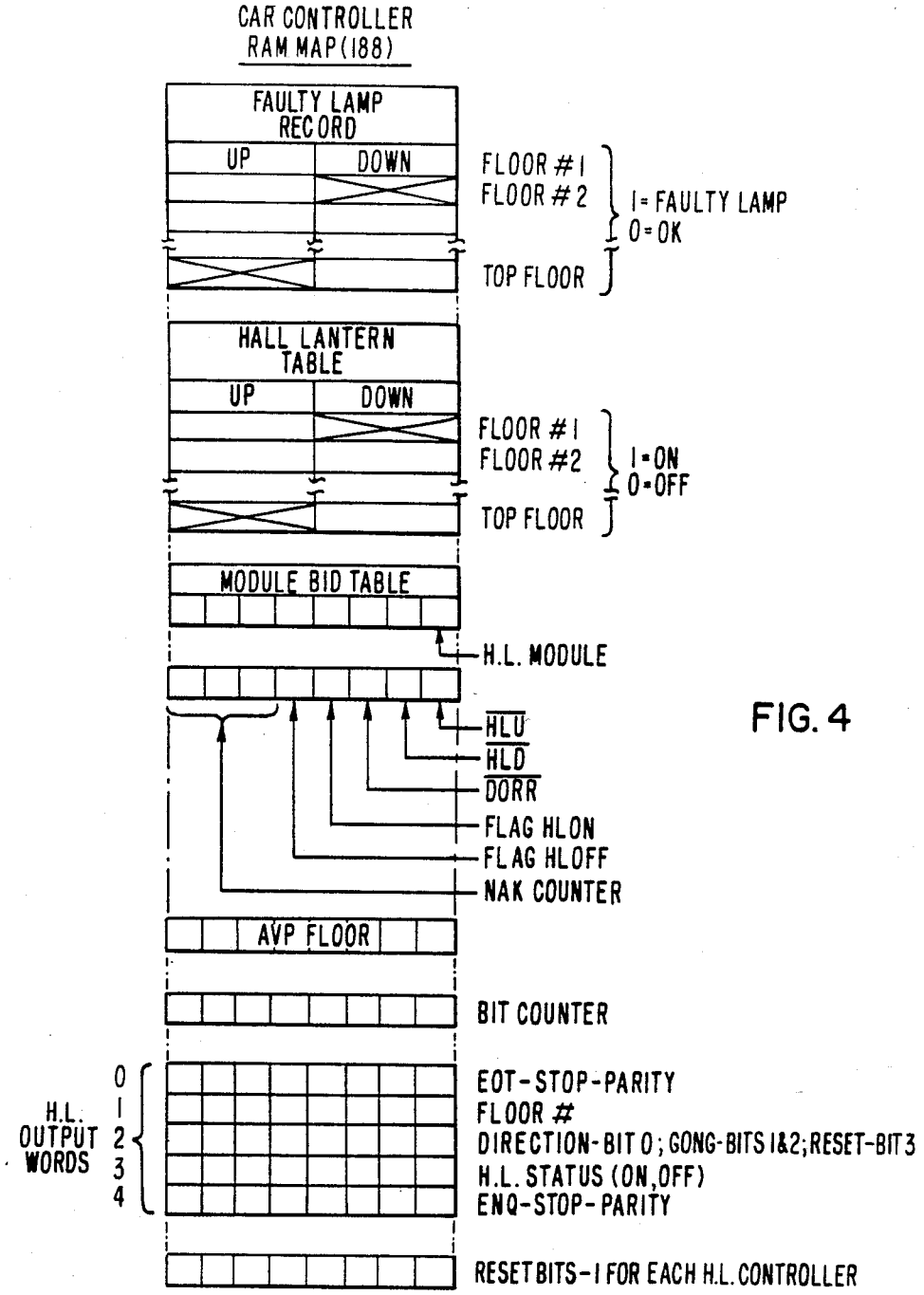
FIG. 4 is a RAM map of the car controller RAM, which illustrates the various signals and tables stored therein by the hall lantern module.
Figure 5:
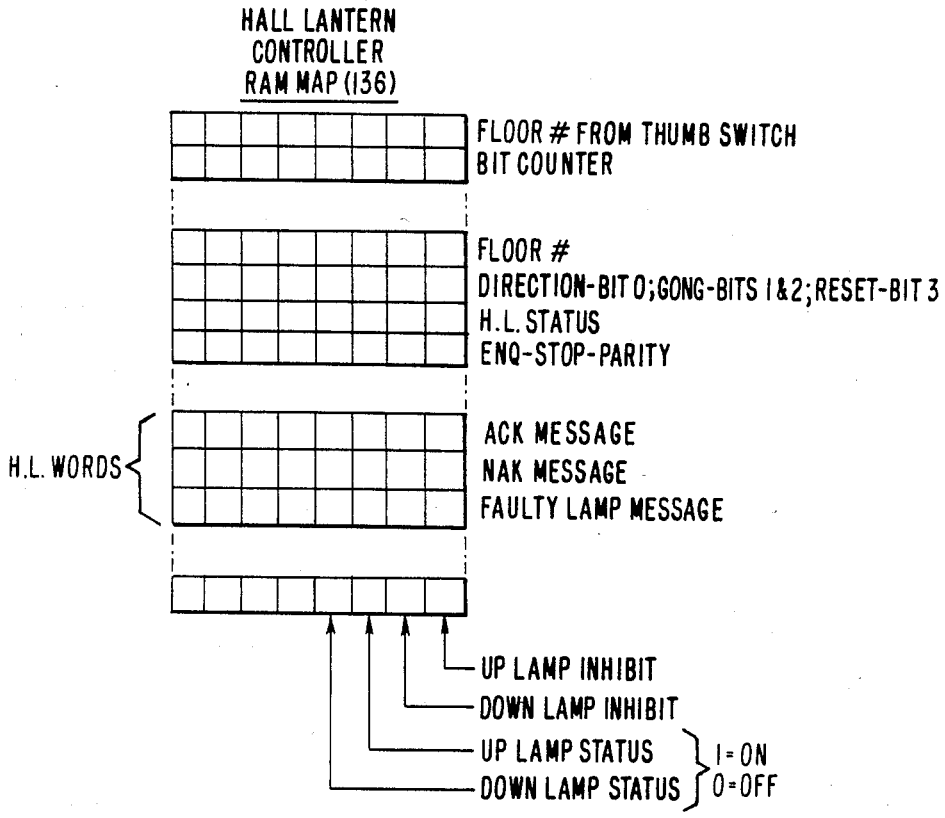
FIG. 5 is a RAM map of a hall controller RAM, which illustrates the signals stored therein by a hall lantern controller.

FIGS. 4 and 5 set forth exemplary RAM map formats of RAMS 188 and 136, respectively, of the car controller 60 and hall lantern controller 108, which will be referred to when describing the remaining figures related to programs stored in ROMS 190 and 138.

Certain of the operating programs of car controller 60 may be in the form of independent modules which are run only when there is a need to run them, and then they are run in a predetermined priority sequence when more than one module has a need to run at any one time. When a need to run for a particular module is detected, such as by another module, or by a hardware interrupt, the program is placed into bid. FIG. 4 sets forth an exemplary format for a module bid table. The module may also place itself into bid, at the completion of its running. The program for linking modules placed into bid in a predetermined priority order is called the priority executive program, with this arrangement being described in greater detail in incorporated U.S. Pat. No. 4,240,527.

Figure 6:
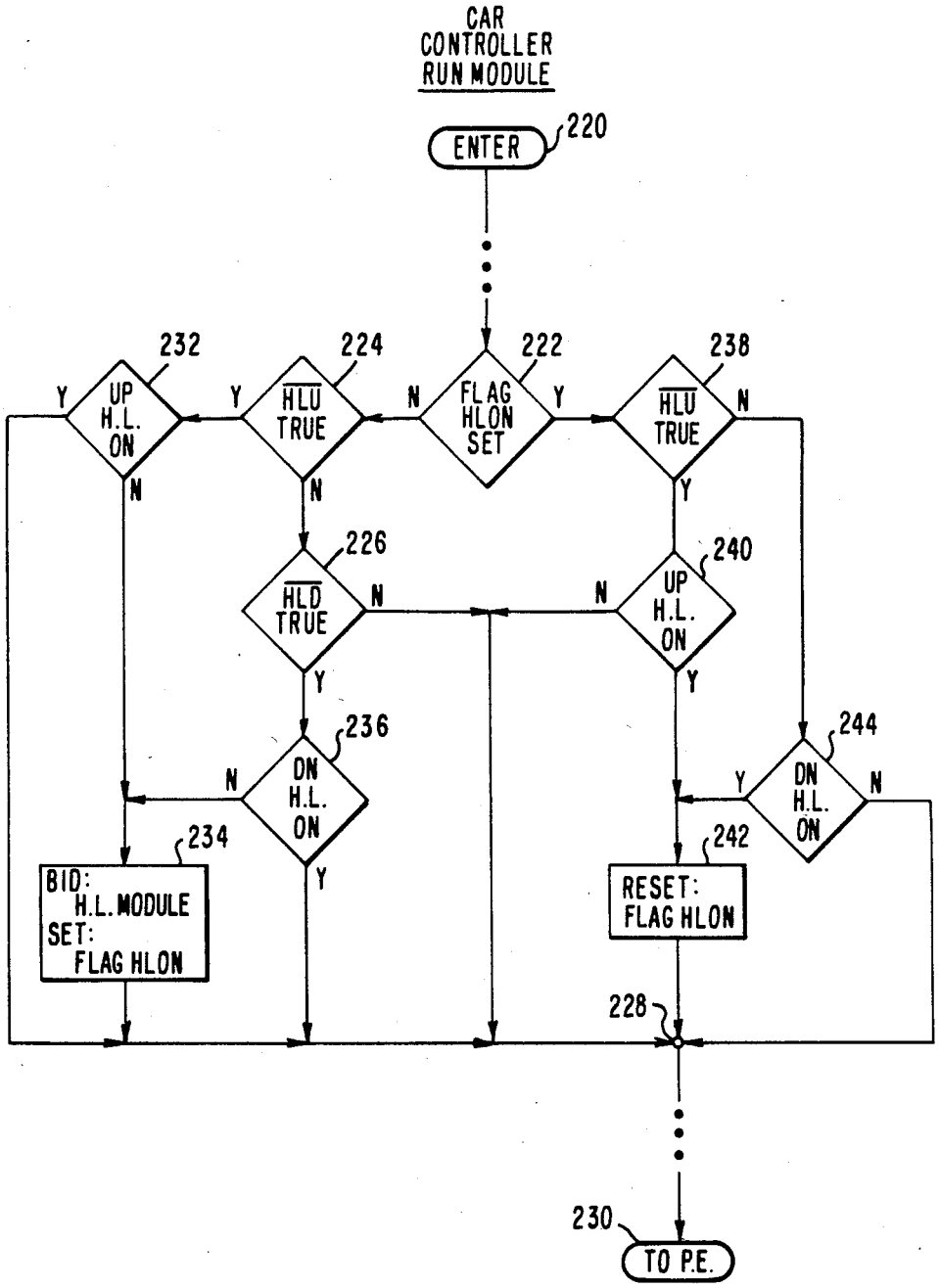
FIG. 6 is a flow chart of a modification with which may be made to the RUN function of a car controller, to signify when a hall lantern should be illuminated.
Figure 8A:
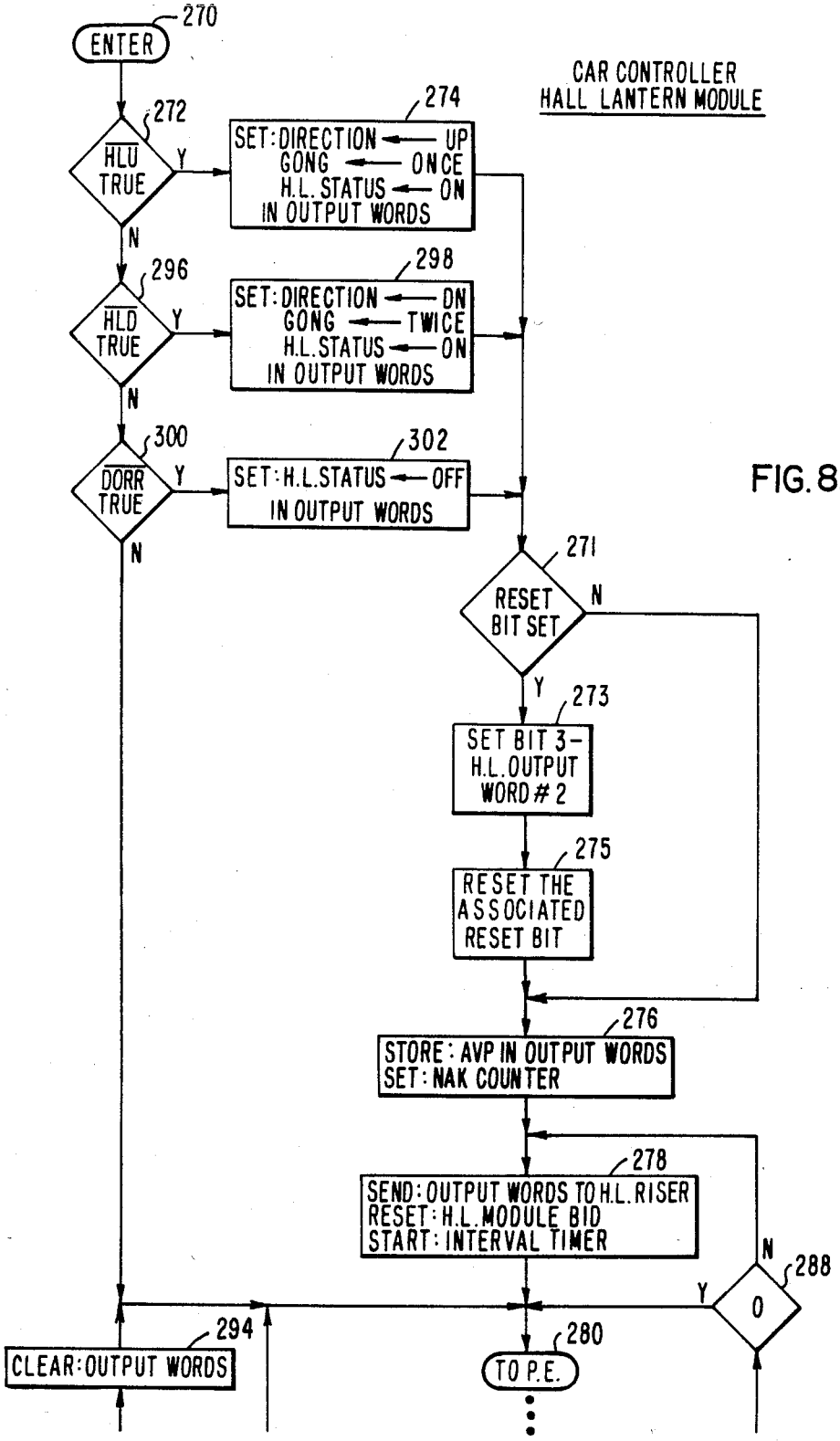
FIGS. 8A and 8B may be assembled to provide a flow chart of a hall lantern module which may be placed into bid by the flow charts set forth in FIGS. 6 and 7, and run by the Priority Executive.
Figure 8B:
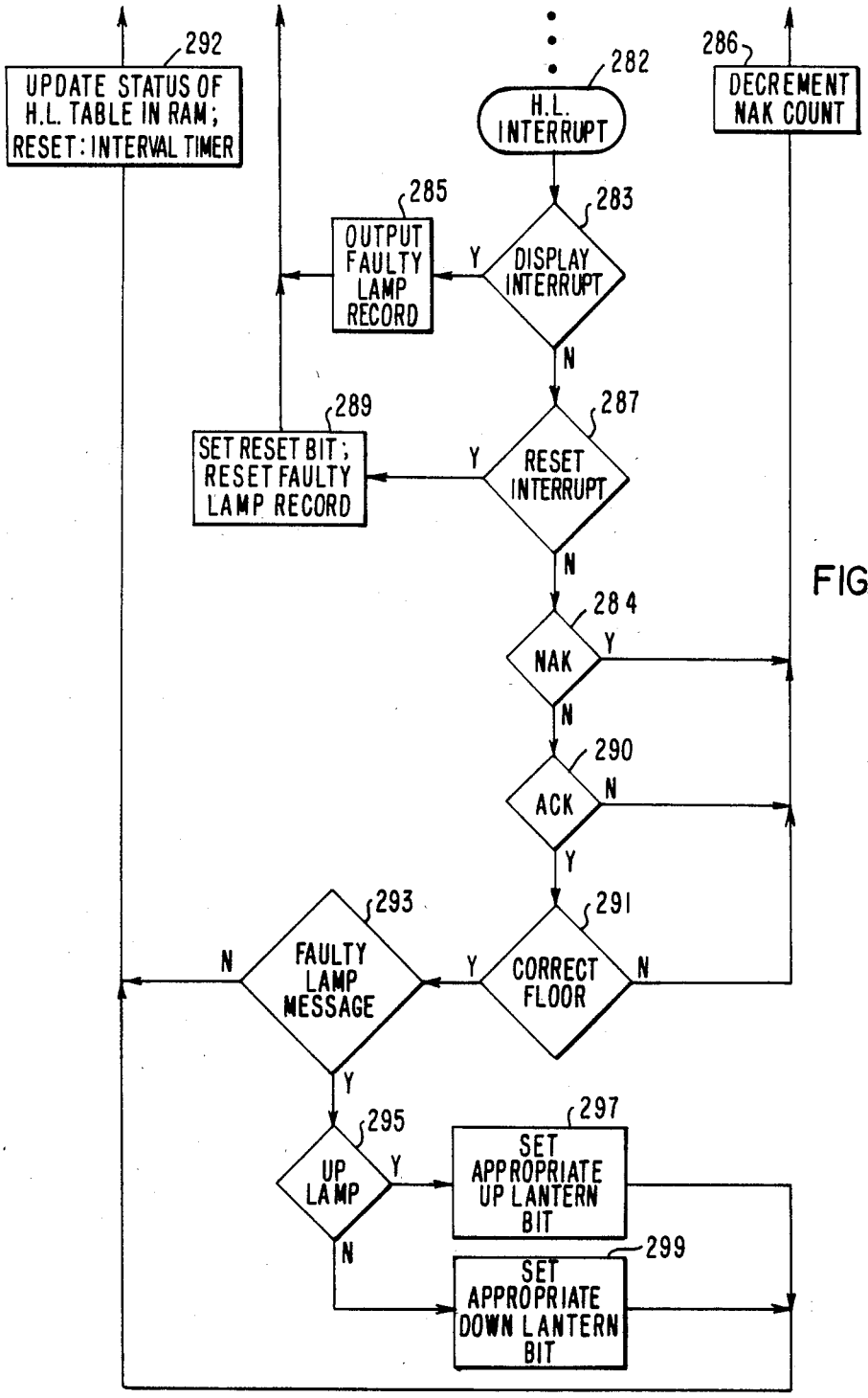

FIG. 6 is a detailed flowchart which may be an integral part of a RUN module of the car controller 60, which controls each run of the elevator car 12. The RUN module, or an equivalent hardware logic function, such as shown in incorporated U.S. Pat. No. 3,750,850, provides true signals $\overline{HLU}$ are $\overline{HLD}$ when the up and down hall lanterns, respectively, should be illuminated. The signals are stored in RAM 188 shown in FIG. 4. A flap HLON, also shown in RAM 188 of FIG. 4, is used to indicate when a hall lantern module has been placed into bid. The hall lantern module, which is shown in FIGS. 8A and 8B, is run when a hall lantern should be turned on, or off, and it will be hereinafter explained.

More specifically, the RUN module of FIG. 6 is entered at 220, and during its running, step 222 will be encountered which checks the status of flag HLON. If flag HLON is not set, it means the hall lantern module has not been placed into bid, and the program proceeds to check to see if it should be placed into bid. Step 224 checks to see if $\overline{HLU}$ is true, indicating a request to turn on an up hall lantern. If it is not true, step 226 checks signal $\overline{HLD}$. If it is not true, the program proceeds to terminal 228, ending the hall lantern portion of the module. Module RUN eventually completes its running, and returns to the priority executive (PE) at exit 230. If step 224 finds signal $\overline{HLU}$ true, step 232 checks the up hall lantern status stored in RAM 188 (FIG. 4). If it is already on, step 232 proceeds to terminal 228. If it is not on, step 234 places the hall lantern module into bid by setting bit position zero of the bid table shown in FIG. 4, and it sets flap HLON, also shown in FIG. 4 to signify the hall lantern module has been placed into bid. Step 234 proceeds to terminal 228.

If step 226 finds signal $\overline{HLD}$ true, step 236 checks the status of the down hall lantern, proceeding to terminal 228 if it is already on, and proceeding to step 234 if it is not. If step 222 finds flag HLON set, the program then determines if the hall lantern module has been run and the appropriate hall lantern illuminated. Step 238 checks to see if $\overline{HLU}$ is true. If it is, step 240 checks the status of the up hall lantern in RAM 188 (FIG. 4). If it is not on, step 240 proceeds to terminal 228. If it is on, step 240 proceeds to step 242, which resets flag HLON. Step 242 proceeds to terminal 228.

If step 238 finds $\overline{HLU}$ is not true, signal $\overline{HLD}$ must be true and step 244 checks the status of the down hall lantern. If it is not on step 244 proceeds to terminal 228, and if it is on, flap HLON is reset in step 242.

The next time the program is run, step 222 will find flag HLON not set, one of the signals $\overline{HLU}$ or $\overline{HLD}$ true, and the associated hall lantern on, and simply bypass step 234.

Figure 7:
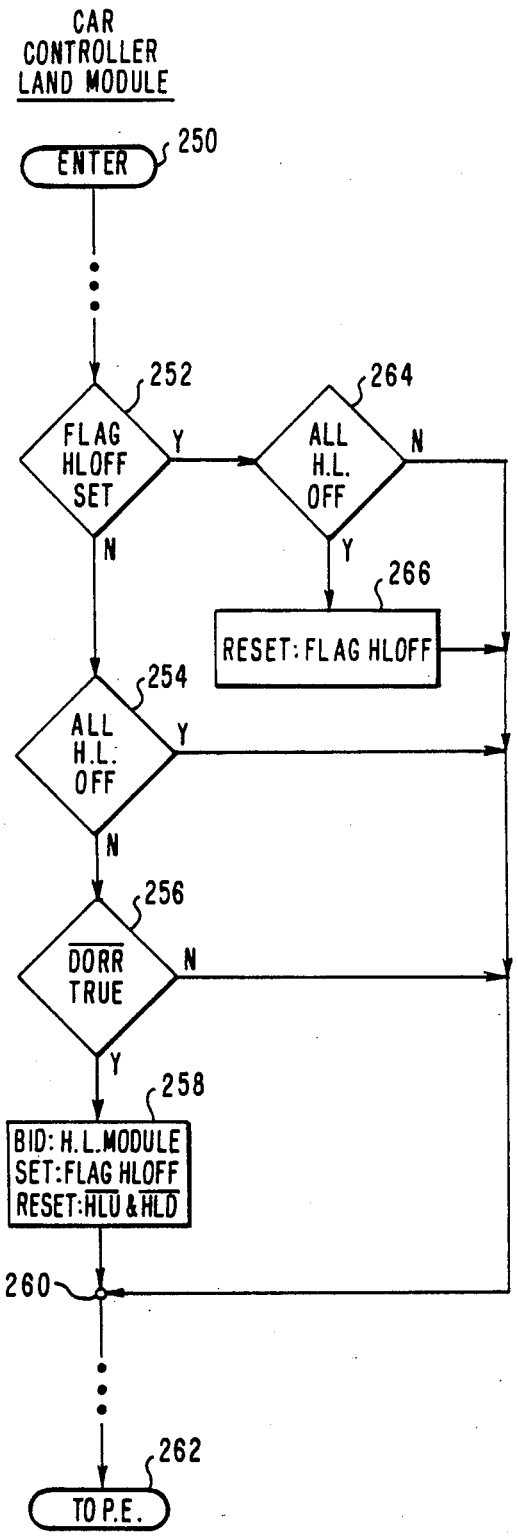
FIg. 7 is a flow chart of a modification which may be made to the LAND function of a car controller, to signify when a hall lantern should be turned off.

When car 12 stops at a floor, a program module LAND, shown in FIG. 7, may be run periodically. Module LAND, among other things, checks to determine when the hall lantern module, shown in FIGS. 8A and 8B, should be placed into bid, in order to turn off a hall lantern. This module may monitor the hall lantern enable signals $\overline{HLU}$ or $\overline{HLD}$, or it may monitor the door close request $\overline{DORR}$, which is driven low or true to request the door operator to close the car and hatch doors. The energized hall lantern should be turned off at the time the doors are requested to close.

More specifically, module LAND is entered at 250, and step 252 checks a flag HLOFF stored in RAM 188, as shown in FIG. 4. Flag HLOFF is set to signify that a hall lantern should be turned off, and that the hall lantern module shown in FIGS. 8A and 8B has been placed into bid in order to accomplish this function. At this point, it will be assumed that step 252 finds flap HLOFF is not set, and step 254 checks the status of the hall lanterns, such as by checking a status table in the RAM shown in FIG. 4. If a hall lantern is on, step 256 checks RAM 188 to see if signal $\overline{DORR}$ is true. If it is true, step 258 places the hall lantern module into bid by setting bit position zero of the module bid table in RAM 188, it sets flag HLOFF, and it resets $\overline{HLU}$ and $\overline{HLD}$ in RAM 188. Step 258 proceeds to terminal 260, and eventually to the exit terminal 262. If step 256 finds signal $\overline{DORR}$ not true, it proceeds to terminal 260, bypassing step 258.

If step 252 finds flag HLOFF not set, and step 254 finds the hall lanterns are both off, step 254 proceeds to terminal 260.

If step 252 finds flap HLOFF set, step 262 checks the status of the hall lanterns in RAm 188. If a hall lantern is on, step 264 proceeds to terminal 260. If all hall lanterns are off, step 264 proceeds to step 266, which resets flag HLOFF.

The hall lantern module of the car controller 60 shown in FIGS. 8A and 8B is run, in its proper priority order, once it has been placed into bid by the RUN or LAND modules shown in FIGS. 6 and 7, respectively. It is entered at terminal 270 and step 272 checks RAM 188 to see if signal $\overline{HLU}$ is true. If it is, step 272 prepares appropriate hall lantern output words in RAM 188 by setting the direction bit to "up", the gong bits to 01 to indicate one gong energization, and the status bit to "on". Step 271 checks to see if the reset bit for this hall lantern controller has been set (RAM 188—FIG. 4), indicating service personnel have corrected all faulty lamps, and the memory of this controller has not been reset yet. It it is set, step 273 sets bit position number 3 of hall lantern output word number 2 (FIG. 4) and step 275 resets the reset bit for this controller in the reset bits shown in FIG. 4. Step 275 proceeds to step 276, as does step 271 if it finds the reset bit is not set. Step 276 further prepares the hall lantern output words by checking the AVP floor in RAM 188, i.e., which is now the floor at which the car 12 is going to stop, and it loads the floor number, in binary, into the appropriate hall lantern word in RAM 188. Step 276 also sets a software counter NAK in RAM 188 to a predetermined count, such as three. Step 278 sends the output words to the serial interface 192, when serial interface 192 indicates it is ready to transmit. It may make this indication via an appropriate interrupt line to the interrupt controller 200. Step 278 also resets the hall lantern module "bid" in RAM 188, and it starts the interval timer 202. Interval timer 202 will be programmed to generate an interrupt at the end of a preset time. If the hall lantern module of the car controller has not noted an acknowledgement that the appropriate hall lantern controller has received the message by the time the interrupt occurs from the interval timer 202, the message will be repeated. Step 278 then returns to the PE at 280.

A hall lantern interrupt, as well as interrupts initiated by pushbuttons 201 and 207 shown in FIG. 3, will be vectored to terminal 281. An interrupt initiated by pushbutton 201 repeats that a predetermined location of RAM 188 be displayed on a CRT screen, or printed, or both. This memory location, shown in the RAM map of FIG. 4, is referred to as the "faulty lamp record". This pushbutton would be actuated by service personnel to determine if there are any faulty lamps, or lamp circuits, and if so, to also find out where they are located. It would be equally suitable to access this location of memory via the telephone using suitable modems, so remotely located personnel may learn of any lamp problems. When the information in the faulty lamp record or table has been utilized and all of the problems corrected, pushbutton 207 may be actuated to create an interrupt which will reset the faulty lamp record of RAM 188.

A hall lantern interrupt indicates one of three things: (1) no response has been received from a hall lantern controller and the interrupt was generated by the interval timer; (2) a response NAK was received from a hall lantern controller which indicates a hall lantern controller recognized that the message was addressed to it, but a parity error was detected; or (3) a response ACK was received from a hall lantern controller which recognized the message as being directed to it, no error was detected, and the hall lantern controller performed the requested command.

More specifically, the program proceeds from terminal 282 to step 283 which checks to see if the interrupt was initiated by pushbutton 201, i.e., a "display" interrupt. If so, step 285 outputs the faulty lamp record or table to a visual display, to a printer, to a modem, or the like, and the program returns to the PE at 280.

If step 283 does not detect a display interrupt, step 287 checks to see if the interrupt was generated by pushbutton 207, i.e., a "reset" interrupt. If so, step 289 resets the location of RAM 188 which stores the faulty lamp record, it sets all of the reset bits in RAM 188 to indicate a need to reset the memories of the hall lantern controllers, and then the program returns to the PE. If step 287 does not detect a reset interrupt, step 284 checks to see if an NAK message was received. If so, step 286 decrements the NAK count. The NAK count makes sure the program breaks out of the message repeat loop in the event some malfunction in transmission occurs. Step 288 checks to see if the NAK count has been decremented to zero. If not, step 278 repeats the message. If the NAK count is zero, the message is not repeated. Step 288 may proceed directly to terminal 280, or may first proceed to an appropriate step which will alert maintenance personnel that there is a problem.

If step 284 finds that it was not an NAK caused interrupt, step 290 checks to see if it was an ACK caused interrupt from a hall lantern controller. If not, then it was an interrupt from the interval timer 202, the purpose of which is to decrement the NAK count in step 286.

If step 290 finds an ACK, step 291 checks to make sure it is from the floor the car controller expects it to be from. If it is not, step 291 proceeds to step 286.

If step 291 finds the ACK is from the hall lantern controller associated with the correct floor, step 293 checks the information received to see if it contains a faulty lamp message. As will be hereinafter explained, when a hall lantern controller detects a faulty lamp, it sends this information to the hall lantern module of the car controller 60, which uses this information to update the faulty lamp record or table in RAM 188. If a faulty lamp message is received, step 295 checks to see if the up lamp is faulty. If so, step 297 sets the appropriate up lantern bit in the faulty lamp record. If step 295 does not find the up lamp faulty, step 299 sets the appropriate down lamp bit in the faulty lamp record or table.

If step 293 does not find a faulty lamp message, step 292 updates the status of the hall lantern in question in the hall lantern status stable stored in RAM 188 (FIG. 4), and it resets the interval timer so it will not time out and provide an interrupt. Steps 297 and 299 also proceed to step 292. Step 294 clears the hall lantern output words stored in RAM 188, and it returns to the PE.

If step 272 finds signal $\overline{HLU}$ is not true, step 296 checks signal $\overline{HLD}$. If it is true, step 298 prepares the hall lantern words by setting the direction bit to "down", the gong bits to binary 10, to request two "gongs" and the hall lantern status bit to "on". The illumination command is then further processed as hereinbefore described relative to the $\overline{HLU}$ request.

If step 296 finds $\overline{HLD}$ is not true, step 300 checks to see if signal $\overline{DORR}$ is true. If it is, step 302 sets the hall lantern status bit to "off" and the gong bits to 00, to signify no "gong", in the hall lantern words, and this illumination command is further processed as described relative to the $\overline{HLU}$ command.

If step 300 finds $\overline{DORR}$ is not true, the program simply returns to the PE at 280.

Figure 9A:
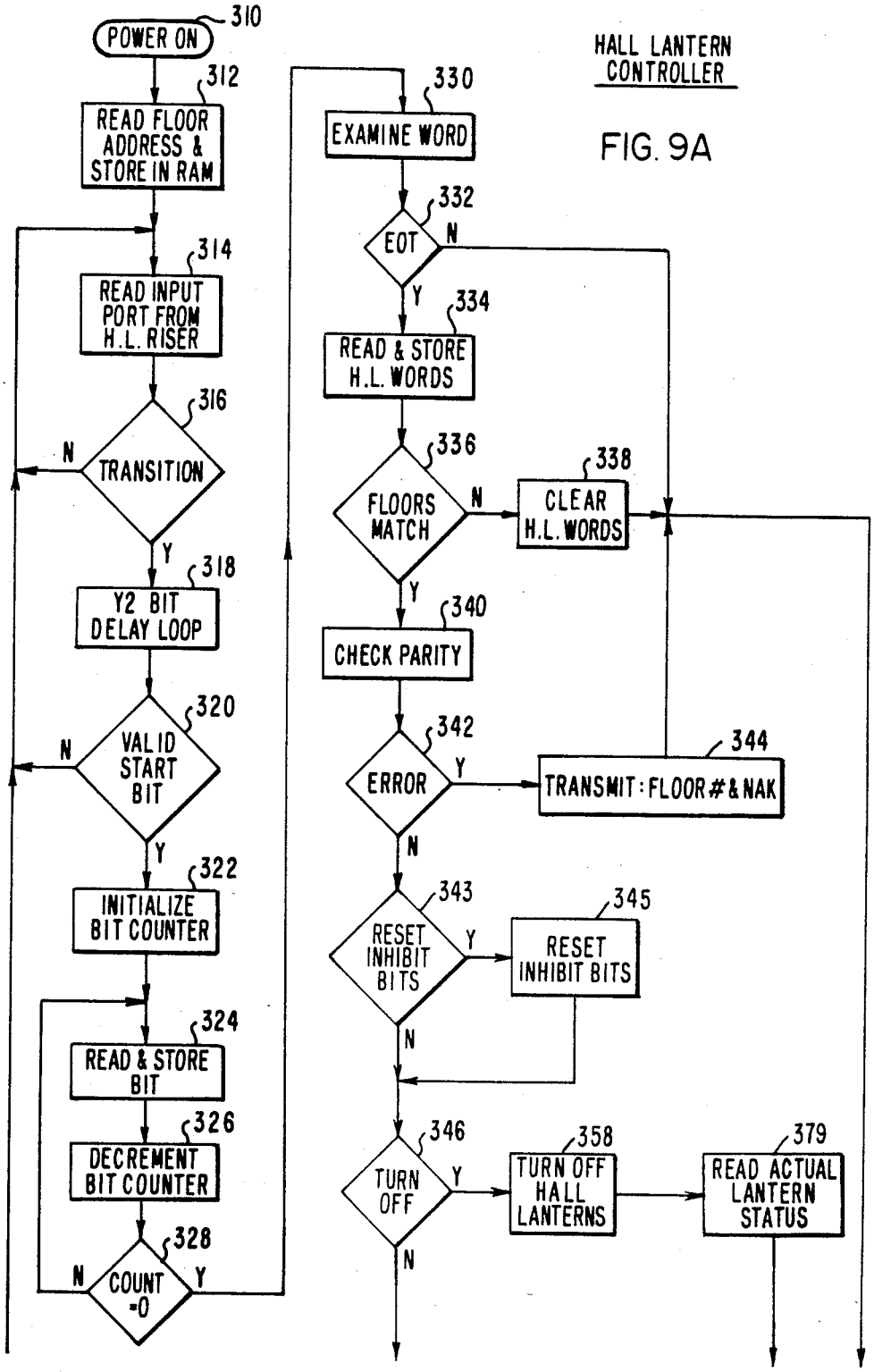
FIGS. 9A and 9B may be assembled to provide a flow chart of a program which may be run by each hall lantern controller.
Figure 9B:
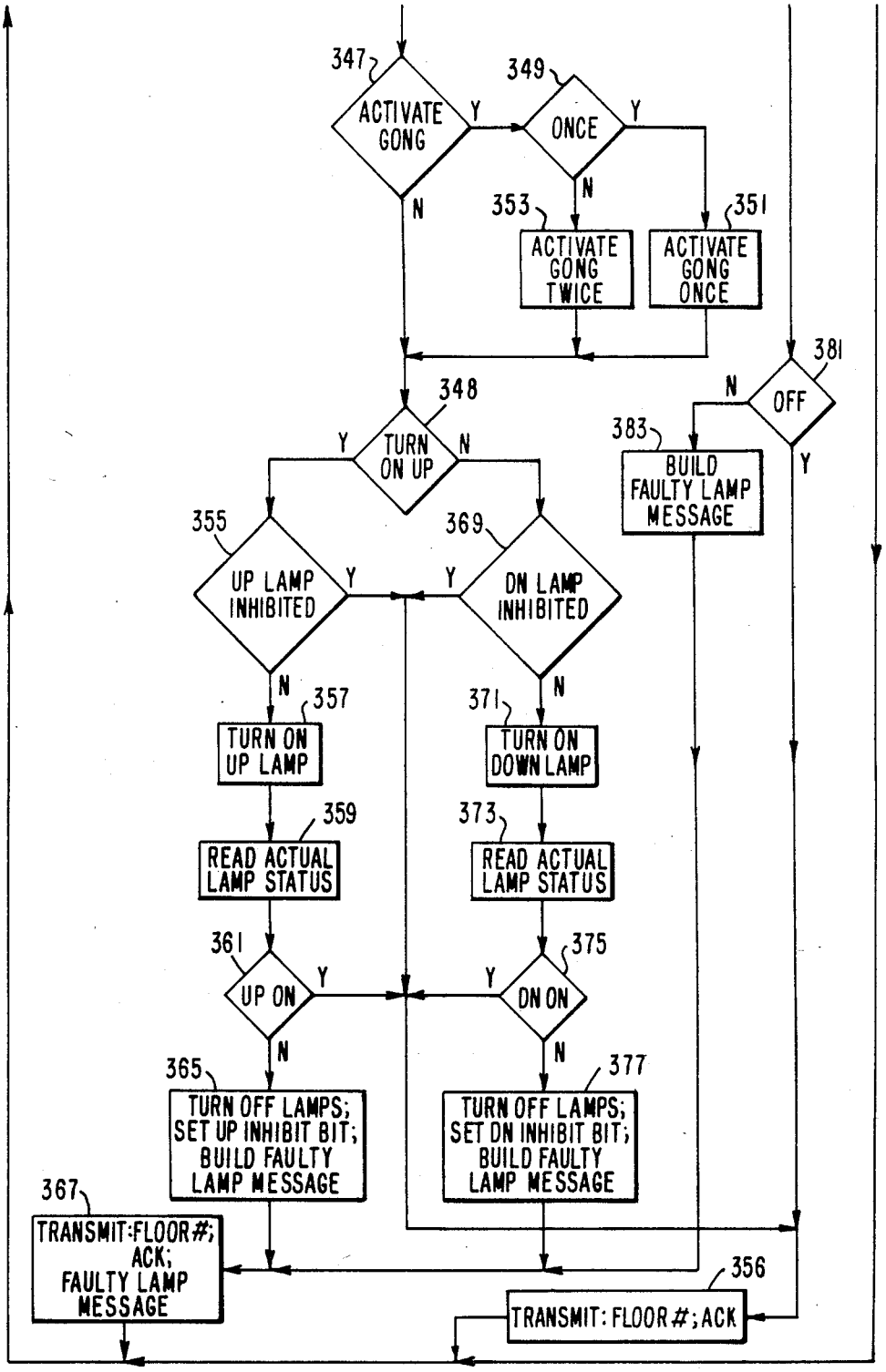

FIGS. 9A and 9B may be assembled to provide a flowchart of a hall lantern program which is run repeatedly by each hall lantern controller, since they may be dedicated controllers having no other tasks to perform. It is entered at 310 when power is turned on, and it initializes itself in step 312 by reading and storing its unique address, i.e., input port 142 is read to determine the address provided by the DIP switch 144. Step 312 proceeds to step 314 which reads the serial input port 140 connected to the hall lantern riser 80. It checks for a start sequence. When there is no message being transmitted, i.e., the data lines BREAK condition, it will detect a space or zero voltage level. To initiate a message transmission, a MARK (predetermined voltage level above zero) must precede the standard "start", or space-going transition. Step 316 checks for a transition and loops back through step 314 until it detects one. When a transition is detected, step 318 provides a delay loop equal to one-half of the serial data clock period, and then step 320 resamples the input. This serves to check that the initial transition was not caused by noise, by moving the sampling point to what should be the center of a valid data bit.

If step 320 detects a valid start bit, step 320 proceeds to step 322. If a valid start bit is not detected, step 320 returns to step 314.

Step 322 initializes a bit counter in RAM 136 (FIG. 5), and eight bits of data are read in sequentially to RAM 136, to form the first input byte. Steps 324, 326 and 328 provide this function. Step 330 then examines this first word. The first word must be the "master" initiation of transmission command EOT. This word, received with correct parity and a valid stop, will initiate the reading of the next four data words, in the same manner as the first word was received. Thus, step 332 checks to see if it is a valid EOT. If not, it proceeds to step 314. If it is a valid EOT, step 334 reads and stores the next four data words, following a sequence similar to steps 322, 324, 326 and 328. The first word may be the floor address in binary of the addressed floor, the second word may include bits which signify the up or down direction, the gong bits, and the reset bit, the third word may signify the requested status, i.e., on or off, and the last word may terminate the message with an ENQ, stop, and parity bit.

Step 336 checks to see if the floor address in the transmission matches its own unique address. If the address is not its own, step 338 clears the hall lantern words in RAM 136 and returns to step 314. If step 336 finds the addresses match, step 340 checks parity. Step 342 determines if there has been an error in transmission. If so, step 344 sends its address and message NAK to the output port 140 for serial transmission over the hall lantern riser 80 to the car controller 60.

If step 342 finds no error, as shown in FIG. 5, a word in memory 136 contains an up inhibit bit and a down inhibit bit. They are set when the up and down lamps they are associated with should not be turned on. If step 342 finds no error, step 343 checks to see if there is a request to reset the inhibit bits. If so, step 345 resets the inhibit bits. Steps 343 and 345 both proceed to step 346. Step 346 checks the status command in the appropriate input word of the illumination command. If it finds that it is not a "turn-off" request, step 347 checks the gong bits. If they are not 00, step 349 checks to see if they are 01. If so, step 351 causes output C of output port 144 to go high, to activate the gong 106, and then it causes the output to return to a logic zero. If step 349 finds the bits are 10, step 353 causes output C to go high, low, high and then low, to signify the down direction by two spaced audible sounds.

Steps 351 and 353 proceed to step 348, as does step 347, when it finds the gong bits 00. Step 348 checks to see if the illumination command requests the turning on of the up lamp 98. If so, step 355 checks its memory (RAM 136) to see if the up lamp had previously been found to be faulty. If the up lamp inhibit bit is not set, step 357 implements the command by causing the A output of port 144 to go high and latch. Step 359 reads the actual lamp status by reading input port 143. The turn on times for the lamp 98 and sensor 129 are less than the response time of a typical one-chip microcomputer (e.g., four words at 300 Baud equals 150 msec.), enabling the lamp status to be checked immediately after lamp activation. Step 361 performs a comparator function by checking to see if the lamp is on. If so, the actual status and commanded status agree, and step 361 proceeds to step 356. Step 356 then transmits the address of the hall lantern controller and the message ACK over the serial hall lantern riser 80. If step 361 finds the up lamp 98 is not on, the actual status does not agree with the commanded status, and step 365 immediately deenergizes lamp 98 by releasing the latched A output. The time between step 357 and step 365 is short enough that damage will not be caused to the hall lantern controller, even if the up lamp circuit is shorted. Step 365 also sets the up inhibit bit shown in FIG. 5 (RAM 136), and it prepares or builds a faulty lamp message or word to be sent to the car controller 60, which message identifies the up lamp for this floor as being faulty. The faulty lamp message is also shown in RAM 136 (FIG. 5). Step 367 then transmits the address of the hall lantern controller, the message ACK, and the faulty lamp message over the riser 80.

If step 355 finds the up lamp inhibited, it proceeds directly to step 356.

If step 348 finds that the turn-on request is not for the up lantern, step 369 checks to see if the down lamp had been previously inhibited and the problem not yet attended to by service personnel. If the inihibit bit in RAM 136 for the down lamp is set, step 369 proceeds to step 356. If it is not inhibited, step 371 implements the command by trying to turn on the down hall lamp 100. It does this by causing output B at port 144 to go high and latch. Step 373 reads input port 143 to determine the actual status of lamp 100. Step 375 performs a comparator function by checking to see if the down lamp is on. If so, step 375 proceeds to step 356. if not, a fault has been detected in the down lamp and/or its circuit, and step 377 releases the latched output B to prevent damage to the hall lantern controller. It also sets the down inhibit bit, and it prepares or builds the faulty lamp message to indicate that the down hall lamp is faulty.

If step 346 finds a turn-off command, step 358 turns off the energized hall lantern by causing both output ports A and B of port 144 to go to the logic zero level.

Step 379 read input port 143 to determine actual lantern status, and step 381 performs a comparator function by checking to see if the lamps are off. If so, step 381 proceeds to step 356. If they are not both off, a fault exists, and step 383 builds the faulty lamp message. Since one or more lamps are on, and will not go off by driving the outputs A and B low, there is no need to set the inhibit bits.

Figure 10:
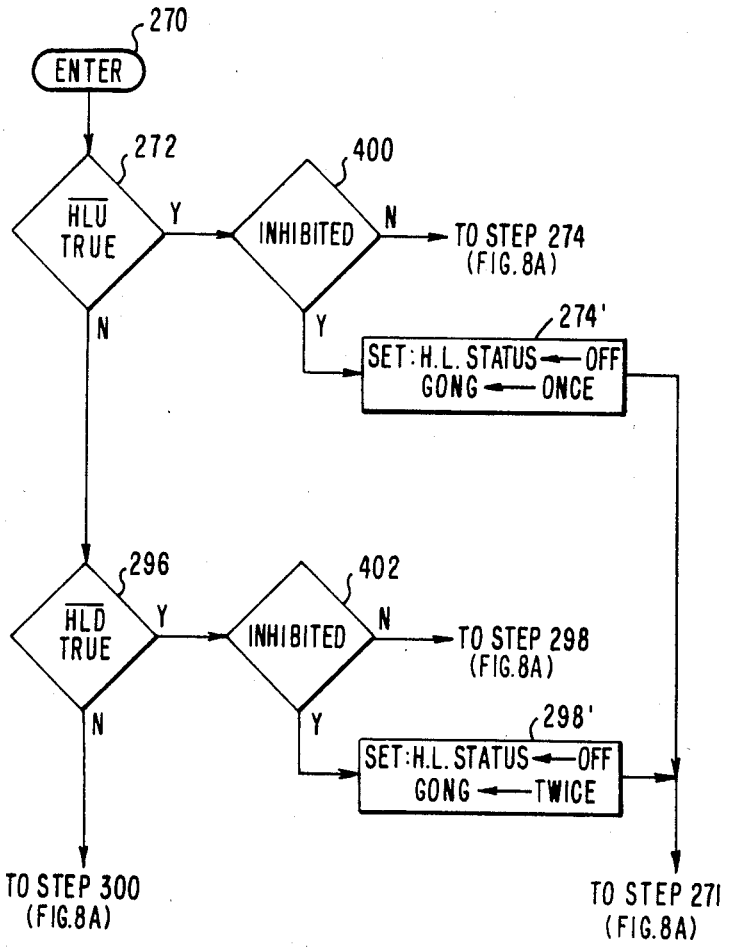
FIG. 10 sets forth a modification of FIG. 8, according to another embodiment of the invention.

In the embodiment of the invention described to this point, the car controller prepared illumination commands without regard to faulty lamps, with the individual hall lantern controllers performing the bypassing of faulty lamps to prevent possible damage to the hall controller. FIG. 10 sets forth a modification of the invention, wherein the car controller checks the faulty lamp record in its own memory 188 (FIG. 4), and if a lamp is indicated as being faulty, it will not request energization of this particular lamp. It will, however, request energization of the associated gong, in order to notify prospective passengers when their hall call is about to be served.

More specifically, FIG. 10 is a modification of FIG. 8A in which a step 400 follows steps 272, when step 272 finds signal $\overline{HLU}$ true. Step 400 checks the faulty lamp record relative to the up hall lamp for the floor in question. If the up lamp for this floor is not inhibited, step 400 proceeds to step 274, which was hereinbefore described. If this particular lamp is found to be faulty, step 400 proceeds to step 274′ which sets the hall lantern status bit to "off", and the gong bit to "once". Step 274′ proceeds to step 271, hereinbefore described.

If step 272 does not find $\overline{HLU}$ true, but step 296 finds $\overline{HLD}$ true, step 402 checks to see if the down lamp for the floor in question is faulty or inhibited. If not, step 402 proceeds to step 298, hereinbefore described. If step 402 finds this lamp to be faulty, step 298′ sets the hall lantern status bit to "off", and the gong bit to "twice", to indicate the down service direction. Step 298′ then goes to step 271, hereinbefore described.

Thus, the hall lantern controllers may detect faulty lamps, and also perform the function of bypassing the faulty lamps, notwithstanding commands by a remote controller to energize lamps. In this embodiment of the invention the individual hall lantern controllers notify the remote car controller of the faulty lamp, and the car controller stores the information as an aid for service personnel. As set forth in another embodiment of the invention, the hall lantern controllers may detect faulty lamps, and the hall lantern module in the car controller can perform the function of bypassing the faulty lamps by not issuing turn-on assignments for these lamps. Finally, the hall lantern controllers may detect faulty lamps, and both the hall lantern controllers and the hall lantern module of the car controller can utilize the lamp bypassing capability in a redundant arrangement, if desired.

We claim as our invention:

1. An elevator system, comprising:

a building having a plurality of floors, an elevator car mounted for movement in said building, car controller means for directing said elevator car to serve floors of said building, lamp means at each floor served by said elevator car, with said lamp means including at least one lamp, said car controller means preparing and issuing illumination commands for selectively controlling the illumination status of the lamp means, processor means at each floor served by said elevator car, and communication means having first, second and third conductors, with said third conductor being common to the first and second conductors, said car controller means selectively addressing and communicating illumination commands to each of said processor means via said first communication conductor, each of said processor means including means for implementing illumination commands for its associated lamps, including means for energizing and deenergizing said lamps, each of said processor means further including means for testing the results of each implementation, with said means including detector means, comparator means, and memory means, said detector means determining the actual illumination status of each lamp associated with the processor, said comparator means comprising the actual illumination status of each associated lamp with the commanded status, to detect lamp malfunctions, said processor memory means storing malfunction indications detected by said comparator means, each of said processor means including means for preparing and transmitting response messages to said car controller via said second communication conductor, with said response messages including an acknowledgement when an illumination command has been actually implemented, as determined by said detector means and said comparator means, and a malfunction indication when detected by said detector means and said comparator means, said car controller means including memory means for maintaining a lamp status table and a lamp malfunction table in response to said response messages, with said car controller means being responsive to the status of the elevator system, said lamp status table, and said lamp malfunction table when preparing commands for the processor means, preparing an energizing command for a lamp only in the absence of a stored malfunction indication relative to the lamp, said first, second and third conductors handling all of the communications between said car controller means and said processor means, regardless of the number of said processor means.

2. The elevator system of claim 1 including audible means at each floor which is normally energized by the associated processor means each time a lamp is energized, with the controller means issuing a command requesting a processor means to energize its associated audible means each time an associated lamp should be illuminated, regardless of whether or not it issues a command to energize a lamp.

3. The elevator system of claim 1 including means for retrieving indications of malfunctions from the memory means of each processor means to facilitate the location of malfunctions.

4. The elevator system of claim 1 wherein each processor means includes means for checking its associated memory means prior to implementing an illumination command for a lamp, with the processor means implementing an illumination command for an associated lamp only in the absence of a malfunction indication in its memory means relative to the lamp.

5. The elevator system of claim 4 including audible means at each floor which is normally energized by the associated processor means each time it receives an illumination command from the controller means requesting the energization of a lamp, with a processor means energizing its associated audible means in response to each such illumination command, regardless of whether or not it actually energizes a lamp.

* * * * *